US005343811A

United States Patent [19]

Schuster

[11] Patent Number: 5,343,811

[45] Date of Patent: Sep. 6, 1994

[54] MAGNETIC POWER SYSTEM FOR LOW-FRICTION TRANSPORTATION OF LOADS

[76] Inventor: Peter Schuster, Prinzregentenstr. 41, D-8201 Raubling, Fed. Rep. of Germany

[21] Appl. No.: 157,356

[22] Filed: Nov. 23, 1993

Related U.S. Application Data

[63] Continuation of Ser. No. 853,894, Mar. 19, 1992, abandoned, which is a continuation of Ser. No. 733,954, Jul. 19, 1991, abandoned, which is a continuation of Ser. No. 664,413, Feb. 28, 1991, abandoned, which is a continuation of Ser. No. 559,382, Jul. 24, 1990, abandoned, which is a continuation of Ser. No. 423,684, Oct. 17, 1989, abandoned, which is a continuation of Ser. No. 124,937, Oct. 23, 1987, abandoned.

[30] Foreign Application Priority Data

Feb. 27, 1986 [DE] Fed. Rep. of Germany ..... 3606459
Oct. 16, 1986 [DE] Fed. Rep. of Germany ..... 3635258

[51] Int. Cl.[5] ..... B60L 13/04; B60L 13/06; B60L 13/10

[52] U.S. Cl. ..... 104/283; 104/281; 104/284

[58] Field of Search ..... 104/281, 282, 283, 284, 104/285, 286

[56] References Cited

U.S. PATENT DOCUMENTS

| | | | |
|---|---|---|---|
| 2,812,203 | 11/1957 | Scholten | 335/302 X |
| 3,589,300 | 6/1971 | Wipf | 104/281 |
| 3,717,103 | 2/1973 | Guderjahn | 104/281 |
| 3,780,668 | 12/1973 | Schwärzler et al. | 104/281 |
| 3,841,227 | 10/1974 | Fink | 104/281 |
| 3,842,750 | 10/1974 | Miericke | 104/286 |
| 3,871,301 | 3/1975 | Kolm et al. | 104/282 |
| 3,885,504 | 5/1975 | Baermann | 104/283 |
| 3,895,585 | 7/1975 | Schwarzler | 104/290 |
| 3,934,183 | 1/1976 | Saufferer | 104/294 X |
| 3,951,074 | 4/1976 | Cooper | 104/286 |
| 4,142,469 | 3/1979 | Polygreen | 104/283 X |
| 4,148,260 | 4/1979 | Minovitch | 104/283 X |
| 4,307,668 | 12/1981 | Vinson | 104/281 |
| 4,324,185 | 4/1982 | Vinson | 104/283 |
| 4,356,772 | 11/1982 | Van der Helde | 104/283 |
| 4,624,617 | 11/1986 | Belna | 104/282 X |
| 4,636,666 | 1/1987 | Meins | 104/292 X |
| 4,646,651 | 3/1987 | Yamamura et al. | 104/286 X |
| 4,711,182 | 12/1987 | Alexandrov et al. | 104/283 |
| 4,787,317 | 11/1988 | Bohn et al. | 104/281 |
| 4,805,761 | 2/1989 | Totsch | 104/283 |
| 4,918,345 | 4/1990 | Vaillan de Guelis et al. | 104/281 |

*Primary Examiner*—Michael S. Huppert
*Assistant Examiner*—Virna Lissi Ansley
*Attorney, Agent, or Firm*—Anderson Kill Olick & Oshinsky

[57] ABSTRACT

The invention resides in a magnetic force system for frictionless transportation of loads, with at least one magnet (1) secured to the load (7), the magnet being arranged with respect to a ferromagnetic support profile (2). It is important that the magnet (1) be arranged with respect to the profile (2) such that the pole surfaces of the magnet (1) cooperate with at least one vertical profile wall, and are essentially parallel to that wall. A particularly good embodiment is obtained by providing magnets on both sides of a profile wall (2), the magnets having identical poles toward the wall (repulsion principle). Longitudinally, the magnets are arranged in pairs and are close-circuited in pairs by a ferromagnetic plate (4).

16 Claims, 3 Drawing Sheets

MAGNETIC POWER SYSTEM FOR LOW-FRICTION TRANSPORTATION OF LOADS

This is a continuation application of Ser. No. 07/853,894, filed Mar. 19, 1992 now abandoned; which is a continuation of Ser. No. 07/733,954, filed Jul. 19, 1991 now abandoned; which is a continuation of Ser. No. 07/664,413 filed, Feb. 28, 1991 now abandoned; which is a continuation of Ser. No. 07/559,382, filed Jul. 24, 1990 now abandoned; which is a continuation of Ser. No. 07/423,684, filed Oct. 17, 1989 now abandoned; which is a continuation of Ser. No 07/124,937 filed Oct. 23, 1987, now abandoned.

The invention relates to a magnetic system for the low-friction transportation of loads, in accordance with the introductory portion of claim 1.

Known magnetic power systems, also called glide systems, move in a practically frictionless manner over support rails, with a particular separation gap from the rails. These systems are generally very expensive and complicated, so that their profitableness comes into question.

In the VDI-news No. 1 of 03.01.86, the Magnetic Railway "Transrapid 06" of Emden is described. It is evident that a large technical expenditure is necessary in order to support the vehicle at a height of 1 cm. Unfortunately, the energy consumption necessary to float the 120 ton vehicle is not given. With a load of 196 persons, this corresponds to a weight of about 120,000 kg, which is 612 kg per person (allowing 80 kg per person). To this must be added the expense of the practical application, and the still unsolved problems relating to snow and ice.

Substantial difficulties have been experienced in the known Japanese suspension railways. Some of these must proceed on wheels until a speed of 200 km/h is reached, at which point the suspension begins.

The so-called "Berlin Magnetic Railway", described in DE-OS 24 26 053, functions in a similar way. The difference here lies in the fact that the guiding rollers are directed over the magnetic field.

Additionally, in the French Application 22 28 650 there is described a magnetic transportation system in which magnets, in particular permanent magnets, are positioned with respect to ferromagnetic profiles. The magnets are however arranged relatively to the profiles in accordance with the principle of attraction, i.e. with opposite poles facing each other. Associated with these are the essentially horizontally lying ferromagnetic walls. By this means a relatively small load capacity is attained. The total load here is many times the payload.

From DE-OS 33 47 635 there is known a magnetic power system which is also constructed in accordance with the principle of attraction, i.e. opposed poles in relation to ferromagnetic walls. Here also, a relatively small load carrying capacity is attained. Moreover, the construction utilized is very expensive since many magnets must be employed in order to lift a given load.

Finally, DE-OS 21 46 143 shows a magnetic power system with at least one magnet and at least one pole surface to which the load is secured. Further there is provided a weakly magnetic support profile mounted on a fixed support, the profile wall thereof being vertically oriented and the profile surface projecting in the direction of the support. However, the system uses guide systems with regulated electromagnets as lateral guides, which makes the system construction relatively complex.

The aim of the invention is to provide a magnetic power system of the previously described kind, which does not require adjustment, is simple and easy to construct, and provides a reliable functioning with a minimal consumption of energy.

In accordance with the invention, these aims are attained by means of a magnetic power system with the characteristics of claim 1.

In this connection, the magnets are so arranged with respect to the ferromagnetic profiles that the pole surfaces of the magnets are arranged essentially parallel to the vertical surfaces of the support profile, and that, by mechanical means, on the one hand a specific air gap is attained between the parallel surfaces, and on the other hand a vertical movement capability of the magnets is attained. By this means, a very good guiding level is attained without any adjustment, so that a simpler and cheaper construction can be obtained.

In accordance with a further form of the inventive concept, the transportation system comprises at least one magnet which is disposed within a downwardly open U-profile made of ferromagnetic material. The poles of the magnets are directed to the sides, so that these interact only with the vertical side surfaces of the supporting profile. The gap between the magnet and the support rail permits a floating and gliding movement of the vehicle around curves. In order to ensure an accurate movement around curves it is advantageous to provide guide rollers which hold the magnets precisely in the middle of the profile. If an attempt is made to move the magnets vertically away, an ever increasing force arises to counteract such movement. Under load, the magnets are drawn out of the profile to the point where the restoring force equals the load. In consequence, no adjustment is necessary to establish the vertical position of the magnets. If the magnets are completely shielded from the side walls of the support profile, the force of attraction ceases.

The drive of the vehicle can be arranged in various ways, for example with drive rollers in contact with the support rails, or with the help of a linear motor.

In accordance with a first embodiment of the invention, the support profile can be of ferromagnetic material, shaped as a downwardly open U-profile. In this case, the arrangement includes at least one magnet, whereby the poles of the magnet are directed horizontally, i.e. laterally in the direction of the sides of the U-profile. The magnetic lines will run through the upwardly closed U-profile. Structurally, this is the simplest solution, and one that is very economical.

As an alternative, the support profile can be made as two vertical, essentially parallel side walls made of ferromagnetic material, wherein the side walls are not closed or connected by a ferromagnetic connecting element. Between the inner surfaces of the walls are arranged at least two magnets in sequential positions one behind the other, with their polarities reversed from each other. In this case, the magnetic lines run between two sequentially adjacent magnets and pass through the support plate lying adjacent the poles.

In accordance with the invention, two pairs of magnets can be arranged with respect to a ferromagnetic profile wall. In this case, the poles that are in opposition with respect to the wall are the same. The operation is according to the principle of repulsion. It has been shown that the use of repulsive principle attains a much increased level of effectiveness, just as with the principle of attraction.

A longitudinally directed ferromagnetic pipe can be used as the profile wall, in accordance with the invention.

The effectiveness is even more greatly increased if the outer poles of two longitudinally sequential magnets are close-circuited across a ferromagnetic plate. In particular, in the case of an identical pole arrangement with respect to a support wall, or an arrangement where the magnets are inside and outside of the arms of a U-profile, the close-circuiting of the outer poles of the outer magnets attains an optimum magnetic flux.

An upwardly open U-profile can be used as the element which closes the circuit of the outer magnets. In this case the magnets are arranged in longitudinal contact with each other on the inside of the profile arms.

By the provision of several juxtaposed profiles which have several profile walls parallel to each other with correspondingly arranged magnets, a substantial increase in the payload can be attained.

The magnets utilized can be permanent magnets or electromagnets. The use of permanent magnets provides substantial advantage by comparison to the use of electromagnets. For example, with the use of permanent magnets, no additional energy is necessary for the lift, since the work required for the support is provided at no cost by the permanent magnets. Energy is required only for movement of the vehicle, which for example may be provided by a linear motor. A further advantage is that the gap between the magnets and the support rails does not need to be controlled. The enormous technical expense required in the known systems is not necessary here. By this means, a secure functioning is guaranteed, free of disturbances. By the employment of permanent magnets and the elimination of the heavy electromagnets, the weight is decreased. If the electrical current fails, no problems arise. The vehicle remains suspended in the magnetic field of the permanent magnets. The entire construction becomes easier and therefore more economical both in construction and use. Due to the decreased energy requirement, the system in accordance with the invention is less disturbing to the environment and creates substantially less noise than other known systems.

The magnetic power system according to the invention permits installations having differing constructions. For example, the load being transported by the system can be situated above the profile/magnet combination. This permits what can be called a standing arrangement.

The load being carried by the system can however also be located under the profile/magnet arrangement. This can be called a suspended arrangement. This suspended arrangement can be conceived in several advantageous variations, because in this case the ferromagnet support profile and also the drive element are provided beneath the support system, which may be a concrete support. In this manner, the susceptibility to adverse weather, particularly in winter, can be decreased.

The invention will be described below with respect to several embodiments with reference to the drawings, in which FIGS. 1 through 10 show several embodiments and arrangements of the support profiles and the magnets used in the magnetic power system in accordance with the invention. More particularly:

FIGS. 11 through 14 show possible arrangements for systems utilizing concrete supports in which:

FIG. 11 shows a first arrangement with the load located under the profile/magnet combination (suspended arrangement);

FIG. 12 shows an arrangement with the load above the profile/magnet combination (standing arrangement);

FIG. 13 is a side elevation of a system utilizing a suspended load, in which the load is a personnel transportation vehicle; and FIG. 14 is a front elevation of the arrangement of FIG. 13.

Figure 1:
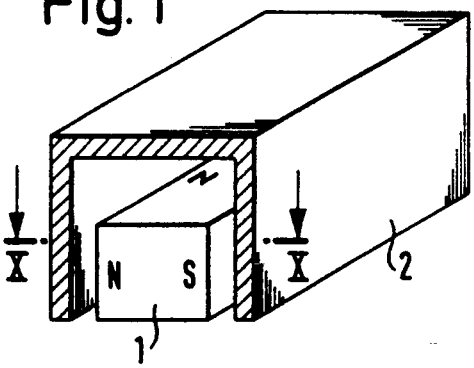
FIG. 1 Shows a first embodiment with a U-shaped support profile and magnets disposed between the arms of the profile, in the unloaded condition.
Figure 2:
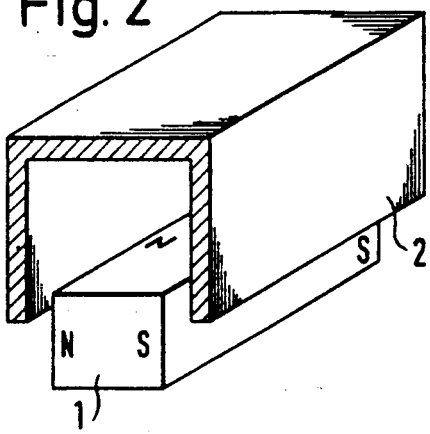
FIG. 2 shows the same arrangement as in FIG. 1, under load, with the magnet vertically displaced below the profile.

In the embodiment shown FIGS. 1 and 2, a U-shaped track made of ferromagnetic material is provided as the support profile 2. Between the two vertical arms of the downwardly open profile 2, a magnet 1 is so provided that the two pole surfaces are located closely adjacent the side walls, and essentially parallel therewith. By this means, the magnetic lines of force from one pole can pass through the nearer side wall, the base of the profile, and the second side wall, thence into the second pole of the magnet 1. The magnetic lines of force thus have an optimum circuit.

FIG. 2 shows the situation arising under a large load with the arrangement according to FIG. 1. The further the magnet is withdrawn downwardly due to a weight fastened thereto, the greater is the force working thereon (suspension force). Under load, the magnets are withdrawn out of the profile to the point where the attractive force is in equilibrium with the load. As a result, no outside control is required to establish the vertical position of the magnets.

Figure 3:
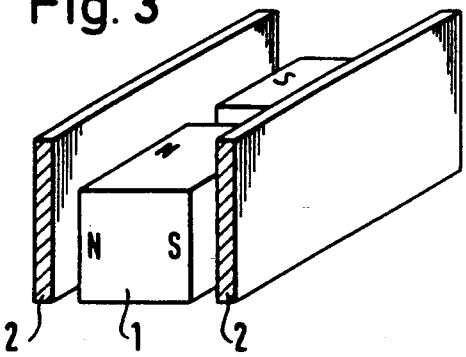
FIG. 3 shows a second embodiment with two plate-like support profiles, and magnets arranged in pairs between them.

In the embodiment shown in FIG. 3, the support profile 2 consists of two vertically arranged ferromagnetic plates, parallel to each other, which are not close-circuited by other ferromagnetic material. Between the inner surfaces of the plates 2 are arranged a pair of magnets sequentially in the longitudinal direction, such that the pair of magnets dispose opposite poles toward each other.

Figure 4:
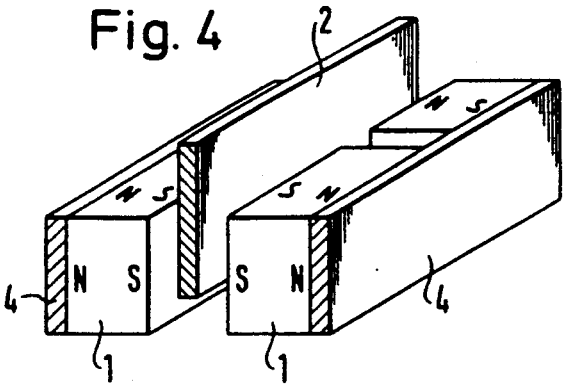
FIG. 4 shows a third embodiment with a plate-like support profile and to either side of the profile magnets arranged in pairs and close-circuited by plates.

The version shown in FIG. 4 shows the track-like support profile 2 to be a flat plate, to either side of which is provided a pair of magnets. With respect to the profile track 2, the corresponding opposed magnets exhibit the same pole toward each other, thus south-south or north-north (principle of repulsion). The outer poles of the respective pairs of magnets that are sequentially arranged in the longitudinal direction are close-circuited through a ferromagnetic plate 4. By this means, the magnetic lines of force are optimized, these lines running between the pair of magnets oriented in the longitudinal direction, and also through the profile 2 and the plate 4.

Figure 5:
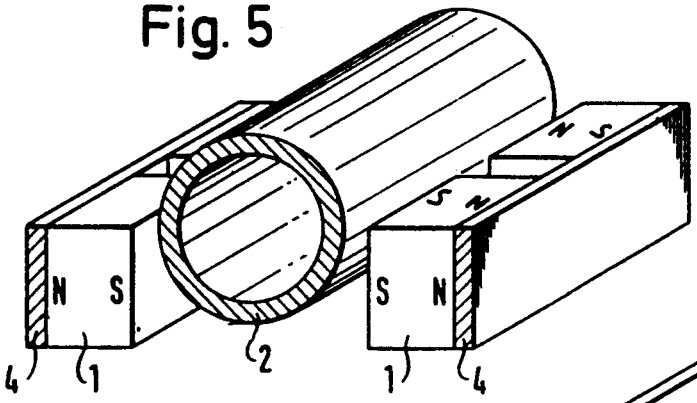
FIG. 5 Shows an embodiment similar to that of FIG. 4, with a pipe in place of the middle profile plate.

FIG. 5 shows an embodiment similar to FIG. 4, with however the difference that a ferromagnetic pipe is used between the magnets instead of the profile wall.

Figure 6:
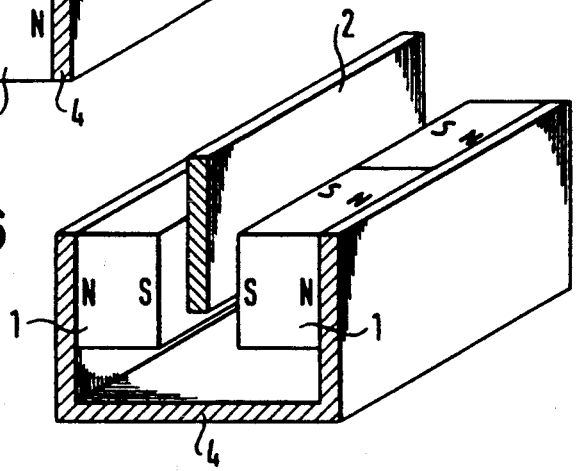
FIG. 6 shows an embodiment as in FIG. 4, with a close-circuit U-profile instead of the plates for the magnets.

FIG. 6 likewise shows an embodiment similar to FIG. 4, however instead of the close-circuiting plate 4 there is utilized an upwardly open U-profile. The magnets are in contact in the longitudinal direction on the inside of the profile arms.

Figure 7:
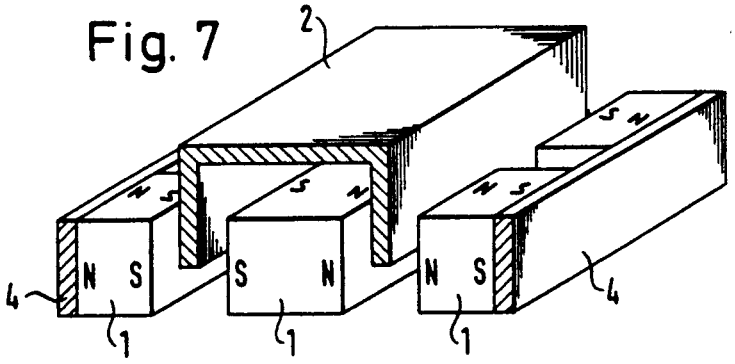
FIG. 7 shows a further embodiment, with a U-shaped support profile, and magnets arranged between the arms and outside the arms.

The embodiment illustrated in FIG. 7 shows a version with increased force, in which the support profile 2 is a downwardly open U-profile. In relation to its two side walls or arms, magnets in the same or similar configuration as in FIGS. 1 and 4 are provided, both between the arms and outside of them. Here also the opposing pole surfaces have the same value, so that the lines of force, repelling each other, take a corresponding circuit through the ferromagnetic support walls or close-circuiting plates. Generally this is a combination of FIGS. 1 and 4 as concerns the circuit of the lines of force, as well as the created supporting force. Thus a corresponding increase in force is attained.

Figure 8:
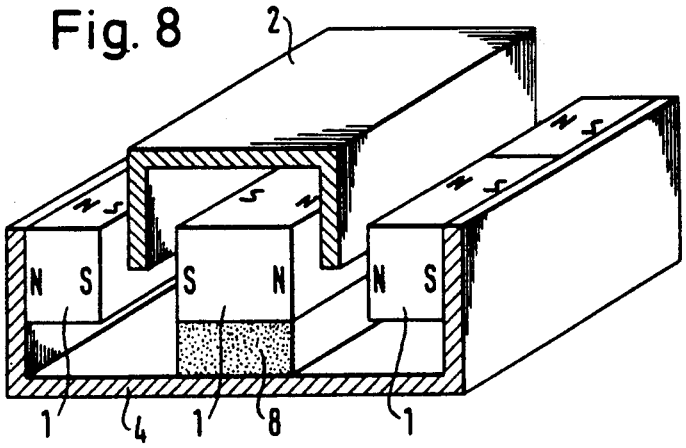
FIG. 8 shows an embodiment as in FIG. 7, utilizing an upwardly open U-profile to close the circuit of the outer magnets.

FIG. 8 shows a similar arrangement as in FIG. 7, however in this case, similarly to FIG. 6, the outer longitudinally contacting magnets 1 are close-circuited through an upwardly open U-profile 4. The inner magnets 1 are spaced away from the close-circuiting profile 4 by an isolation member 8. This embodiment has effectively two magnetic line circuits. The first runs from the inner magnet 1 through the inner U-profile 2, as in the example according to FIG. 1. The second runs through the close-circuiting profile 4, the outer magnets, and then the inner profile 2. By this means, a large magnetic concentration is attained, as in the example of FIG. 7. As the weight increases, however, the efficiency generally does not importantly increase.

Figure 9:
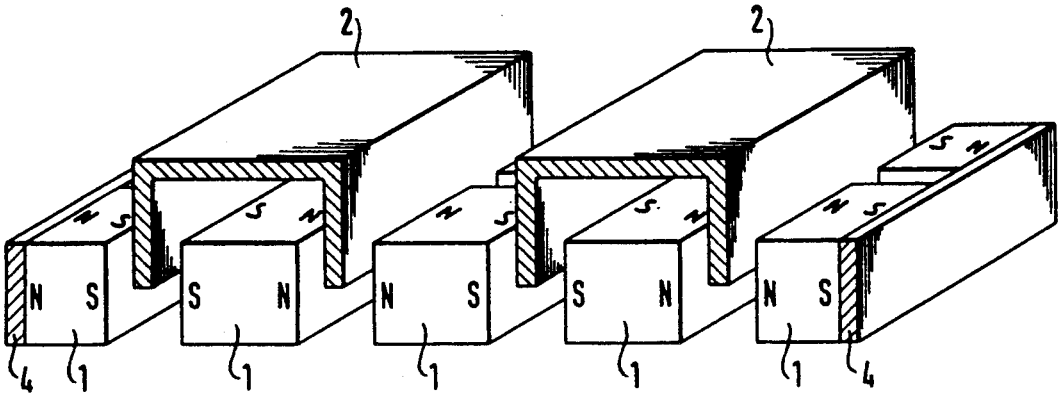
FIG. 9 shows a multiple arrangement of the embodiment of FIG. 7.

FIG. 9 shows a multiple arrangement of the embodiment according to FIG. 7. By means of this arrangement, an increase in force is attained.

Figure 10:
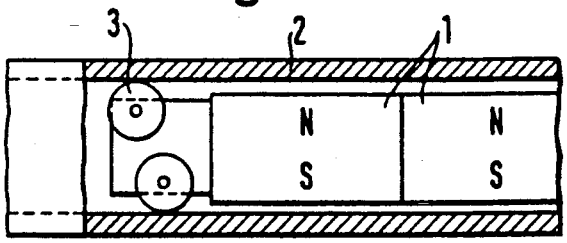
FIG. 10 shows a horizontal section at the line X—X in FIG. 1, specifically the arrangement of guide rollers for the magnets in relation to the profile arms.

In FIG. 10 the disposition of the magnets 1 in relation to the side walls of the support profile 2 can be seen. Guide rollers 3 are so arranged that the magnets remain precisely in the middle between the walls, even around curves.

Figure 11:
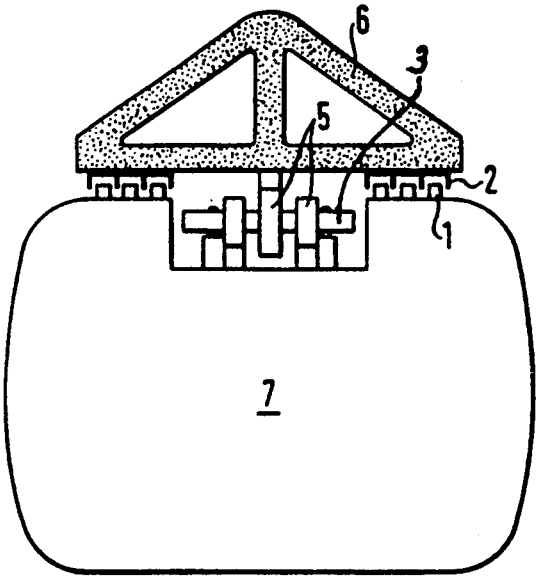

FIG. 11 shows a possible application of the system 1, 2 in the suspended arrangement. The support profiles 2 are fastened on the underside of a concrete support 6, while magnets 1, cooperating with the profiles 2, are provided above a load 7 which hangs underneath, this for example being a transport vehicle. Further, guide rollers 3 are provided on the load or vehicle 7, on the upper extremity thereof, the rollers being operatively associated with intermediate support rails. Propulsion comes about by means of a linear motor 5 arranged in the middle.

Figure 12:
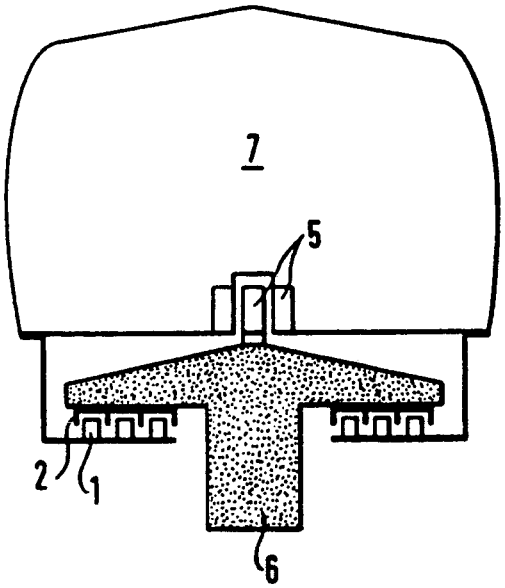

FIG. 12 shows a standing arrangement of the load 7 with respect to the system 1, 2. The profile supports 2 are again located on the underside of the concrete support, or on lateral arms of the concrete support 6. The load or vehicle 7 is positioned above the support 6 and grips under the lateral arms of the concrete support 6, the magnets being so arranged that they cooperate with the supports 2. The concrete support 6 has at the middle of its upper side a guide track with a guide roller (not shown) and the linear motor 5 provided for movement.

Figure 13:
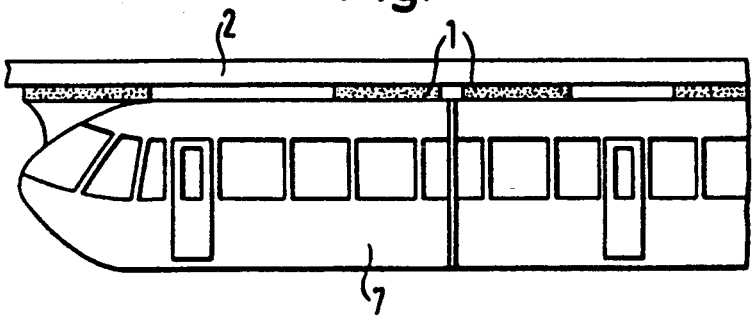
Figure 14:
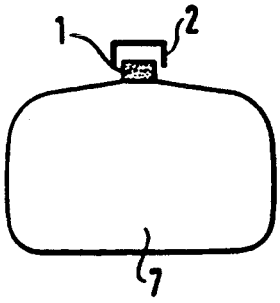

In FIG. 13 and 14, a practical embodiment is illustrated. The load or vehicle 7 is in this case a personnel carrying vehicle. On its upper side the magnets 1 are secured, these extending into a downwardly open U-support. It can be seen that the vehicle 7 moves in the suspended arrangement.

The embodiments of the invention in which an exclusive property or privilege is claimed are defined as follows:

1. In a magnetic force system for low friction transportation of loads in a direction of transportation, the system including:

at least one ferromagnetic support profile and a stationary support, the support profile being secured to the stationary support, the support profile having vertically orientated profile wall which extends parallel to the direction of transportation and to each other;

at least one permanent magnet disposed between the profile walls and extending essentially parallel to the profile walls, the permanent magnet having poles orientated horizontally relative to the direction of transportation;

an essentially constant air gap being defined between each of the at least one permanent magnet and the support profile, wherein the loads are attached to the at least one permanent magnet; and mechanical means for permanently maintaining the air gaps, the improvement comprising:

a downwardly open U-section including the vertical ferromagnetic walls of the support profile which extend parallel to each other, wherein the permanent magnet is disposed between the two profile walls.

2. The magnetic force system according to claim 1, wherein one magnet is disposed between the two profile walls.

3. The magnetic force system according to claim 1, wherein at least two magnets are disposed between the two profile walls, the two magnets being arranged successively in the direction of transportation.

4. The magnetic force system according to claim 3, wherein the two magnets are disposed in equipolar orientation in the direction of transportation, and wherein the two magnets are arranged in contact with each other without an air gap therebetween.

5. The magnetic force system according to claim 3, wherein each of the two profile walls have an outer side, wherein, in addition to the at least one magnet between the two profile walls, at least one outside magnet is mounted adjacent the outer side of each of the two profile walls, wherein equipolar magnet surfaces face each other relative to the profile walls.

6. The magnetic force system according to claim 5, comprising an upwardly open U-section for short-circuiting the outside magnets, and an insulating plate for shielding the at least one magnet between the profile walls from the upwardly open U-section.

7. The magnetic force system according to claim 1, comprising a plurality of downwardly open U-sections and a corresponding number of magnets disposed in a side-by-side arrangement for increasing the payload.

8. The magnetic force system according to claim 1, wherein the load to be transported by the system is mounted above the profile and magnet arrangement.

9. The magnetic force system according to claim 1, wherein the load to be transported by the system is mounted below the profile and magnet arrangement.

10. The magnetic force system according to claim 1, comprising a linear motor as a prime mover in the system.

11. In a magnetic force system for low friction transportation of loads in a direction of transportation, the system including at least one ferromagnetic support profile and a stationary support, the support profile being secured to the stationary support, the support profile having at least one vertically oriented profile wall which extends parallel to the direction of transportation, at least two pairs of permanent magnets located opposite each other relative to the at least one profile wall, wherein one of the pairs of magnets includes two poles oriented transversely of the direction of transportation and alternatingly in the direction of transportation, wherein the magnets are arranged one behind the other in the direction of transportation along the at least one profile wall and essentially parallel to the at least one profile wall, wherein the pairs of magnets have outer poles, a ferromagnetic plate for short-circuiting the outer poles of the magnets, air gaps being defined between the magnets and the at least one profile wall and between the magnets in the direction of transportation, wherein the loads are attached to the magnets, and mechanical means for permanently maintaining the air gaps, the improvement comprising the poles of the magnets arranged opposite each other in relation to the at least one profile wall preventing the same pole orientation, so that the poles of the magnets arranged opposite each other with respect to the profile wall are identical.

12. The magnetic force system according to claim 11, wherein the at least one support profile is a downwardly open U-section, the U-section having two legs forming two profile walls, at least one pair of magnets being disposed between the two profile walls, the pair of magnets arranged between the profile walls being non-short-circuited, the magnets of the at least two pairs of magnets and the magnets of the at least one pair of magnets arranged between the two profile walls being arranged such that the poles of the magnets which face each other in relation to the profile walls are identical.

13. The magnetic force system according to claim 11, comprising a plurality of support profiles and a corresponding number of magnets disposed in a side-by-side arrangement for increasing the payload.

14. The magnetic force system according to claim 11, wherein the load to be transported by the system is mounted below the profile and magnet arrangement.

15. The magnetic force system according to claim 11, comprising a linear motor as a prime mover in the system.

16. A magnetic force system for a low friction transportation of loads in a direction of transportation, the system including:

at least one ferromagnetic support profile and a stationary support, the support profile being secured to the stationary support, the support profile having at least one vertically oriented profile wall which extends parallel to the direction of transportation;

at least two pairs of permanent magnets being located opposite each other relative to the at least one profile wall, wherein one of the pairs of magnets includes two poles oriented transversely of the direction of transportation and alternatingly in the direction of transportation, wherein the magnets are arranged one behind the other in the direction of transportation along the at least one profile wall and essentially parallel to the at least one profile wall, wherein the pairs of magnets have outer poles, a ferromagnetic plate for short-circuiting the outer poles of the magnets;

air gaps being defined between the magnets and the at least one profile wall and between the magnets in the direction of transportation, wherein the loads are attached to the magnets;

mechanical means for permanently maintaining the air gaps;

the improvement comprising the poles of the magnets arranged opposite each other in relation to the at least one profile wall preventing the same pole orientation, so that the poles of the magnets arranged opposite each other with respect to the profile wall are identical;

the at least one support profile is a downwardly open U-section, the U-section having two legs forming two profile walls, at least one pair of magnets being disposed between the two profile walls, the pair of magnets arranged between the profile walls being non-short-circuited, the magnets of the at least two pairs of magnets and the magnets of the at least one pair of magnets arranged between the two profile walls being arranged such that the poles of the magnets which face each other in relation to the profile walls are identical;

the at least one support profile is a plurality of support profiles being paired with a corresponding plurality of magnets disposed in a side-by-side arrangement for increasing the payload; and the load to be transported by the system is mounted above the profile and magnet arrangement.

* * * * *